United States Patent [19]

Donaldson et al.

[11] 4,245,770

[45] Jan. 20, 1981

[54] EGG CONTAINERS

[75] Inventors: Ian S. Donaldson, Holywood; Dennis Legge, Bangor, both of Northern Ireland

[73] Assignee: The Queen's University of Belfast, Belfast, Northern Ireland

[21] Appl. No.: 903,736

[22] Filed: May 8, 1978

[30] Foreign Application Priority Data

May 7, 1977 [GB] United Kingdom ..... 19229/77

[51] Int. Cl.[3] ..... B65D 81/16; B65D 85/32

[52] U.S. Cl. ..... 229/2.5 EC; 217/26.5; 206/421

[58] Field of Search ..... 229/44 EC, 45 EC, 2.5 EC; 217/26, 26.5, 27; 206/421

[56] References Cited

U.S. PATENT DOCUMENTS

| | | | |
|---|---|---|---|
| 417,469 | 12/1889 | Butterick | 217/26.5 |
| 2,885,136 | 5/1959 | Grant | 229/2.5 EC |
| 3,131,846 | 5/1964 | Whiteford | 229/2.5 EC |
| 3,447,731 | 6/1969 | Lehmann | 229/45 EC |
| 3,661,317 | 5/1972 | Noguchi | 229/2.5 EC |
| 3,955,744 | 5/1976 | Casutt | 229/45 EC |

FOREIGN PATENT DOCUMENTS

| | | | |
|---|---|---|---|
| 21186 | of 1929 | Australia | 217/26.5 |
| 2202945 | 8/1972 | Fed. Rep. of Germany | 229/2.5 EC |
| 1482580 | 4/1967 | France | 229/2.5 EC |
| 11613 | 12/1924 | Netherlands | 217/26.5 |
| 1700 | of 1883 | United Kingdom | 217/26.5 |
| 485501 | 5/1938 | United Kingdom | 217/26.5 |
| 1120882 | 7/1968 | United Kingdom | 229/2.5 EC |
| 1165793 | 10/1969 | United Kingdom | 229/2.5 EC |
| 1182105 | 2/1970 | United Kingdom | 229/2.5 EC |
| 1225028 | 3/1971 | United Kingdom | 229/2.5 EC |
| 1298768 | 12/1972 | United Kingdom | 229/2.5 EC |

*Primary Examiner*—Herbert F. Ross

*Attorney, Agent, or Firm*—Fleit & Jacobson

[57] ABSTRACT

Disclosed are pre-packs for eggs which have internal formations adapted always to keep the individual eggs out of contact with each other and such that an egg will always (and only) be supported within the pre-pack by contact of the formations at at least one of the following regions, namely, its waist region, and the regions of its two poles. The external shape of a pre-pack will be elongate, the cross-sectional form being based on a nesting geometrical figure, such as a regular hexagon. Pre-packs are disclosed which are made from transparent plastics material, and which hold one row, or two rows side-by-side, of three eggs. The packs preferably consists of two halves which can be readily and repeatedly separated for removal of eggs contained therein.

9 Claims, 8 Drawing Figures

EGG CONTAINERS

This invention concerns containers for eggs, of the type referred to in the trade as pre-packs.

Egg pre-packs are manufactured in a variety of forms to hold from one to thirty-six eggs. The majority of pre-packs are moulded from pure wood pulp, reconstituted wood pulp, expanded sheet polystyrene, or high-impact polystyrene in sheet form.

The most widely used pre-packs are for six eggs. One of these consists of two hinge-connected halves. The lower half has cells each of which is to locate the lower part of an egg and a top which, when closed, serves to retain the egg in the pre-pack and also present a flat surface to support another similar pack. Another has the top in the form of cells the better to locate the top parts of the eggs. This type of pre-pack is frequently made of transparent high impact polystyrene, and also nest together to some extent.

Such known packs (which all hold the eggs with their major axes vertical) do not protect the eggs, to what we believe to be a sufficient extent, from damage due to impact of the weaker regions of their shells against internal surfaces of the pre-pack, or due to collapse of the pre-packs due to external loading whilst stacked for transportation.

It is the object of the present invention to provide an improved pre-pack for eggs which better protects the eggs from damage, and which has enhanced customer appeal.

According to the present invention a pre-pack for a plurality of eggs has internal formations defining single-egg accommodating locations, and which are adapted, in use, to prevent eggs therein from coming into contact with each other, and to provide support for each egg, at any given time, by contact only at at least one of the following regions thereof, namely, its waist region and the regions of its two poles. By "waist" and "poles" we mean respectively (considering an egg as an ellipsoid) the circumference of the egg at a minor axis, and the extremities of the egg at its major axis. We have found that by supporting and separating eggs in a container in this way they are less likely to be damaged than in known containers.

It is greatly to be preferred that the pre-pack is elongate and has an external transverse cross-sectional shape based on a nesting geometrical figure such as an equilateral triangle, a rectangle, or, especially, a regular hexagon, whereby to facilitate the nesting of a plurality of such pre-packs together. External formations adapted releasably to interlock with like formations on identical pre-packs when in stacked relationship may be provided.

Preferably the single-egg accommodating locations are such as to accommodate eggs with their major axes in line, a convenient number of eggs being three, or six, in two side-by-side series of three eggs in line. This configuration facilitates efficient nesting of the pre-packs together with well-distributed loading, and results in pre-packs which are convenient to handle and neat in appearance, and make efficient use of space in secondary packing.

The pre-pack will conveniently be made in two similar parts, and one or both may be transparent, the parts being hinged or otherwise connected together so as to retain the eggs before use when closed, but readily and repeatedly separable, fully or partly, to give access for the removal of one or more eggs. If the material of the pre-pack is transparent the eggs can be visually examined without opening the container.

The invention will now be described further, by way of example only, with referece to the accompanying drawings, in which, FIG. 1 is a front elevation, partly in section on the line I—I of FIG. 3, of a container for three eggs, in accordance with the invention, with eggs therein;

Figure 1:
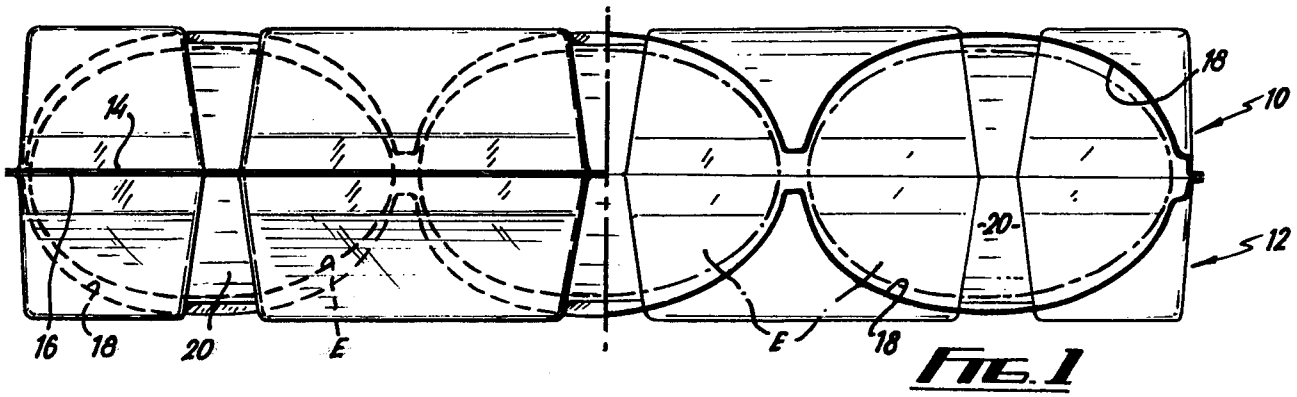
Figure 3:
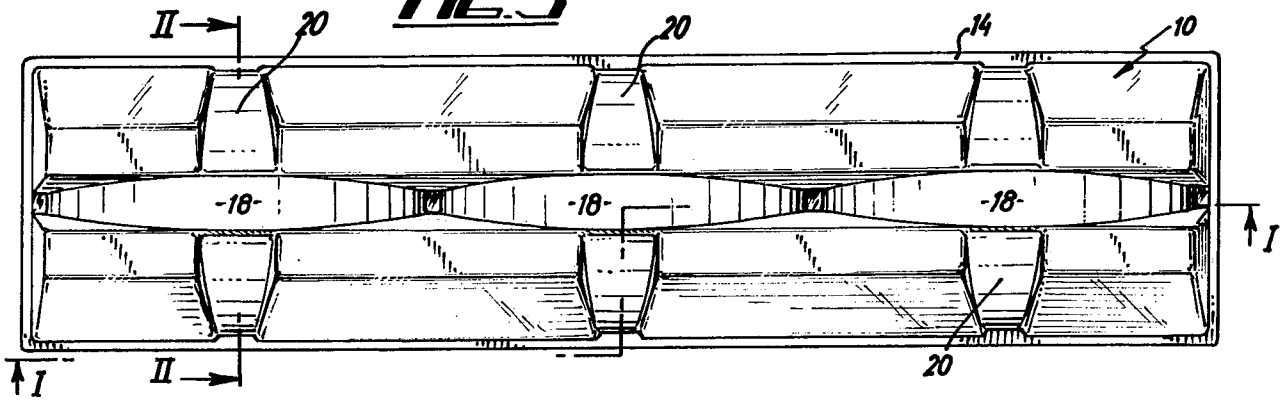
FIG. 3 is a plan view of the container.
Figure 2:
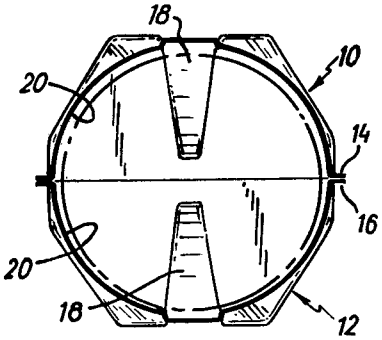
FIG. 2 is a sectional end elevation, on the line II—II of FIG. 3.

The pre-pack shown in FIGS. 1 to 3 and 7 of the drawings is made from a suitable transparent plastics material such as polyvinyl chloride or polystyrene, and is in two similar parts or halves 10, 12. Vacuum forming or hot moulding or other technique may be employed to produce the pre-pack halves. The halves 10, 12 have mating flanges 14, 16 by which they may be secured together by adhesive applied thereto. If the adhesive is of the tacky kind and is applied at intervals on the flanges 14, 16, the two halves 10, 12 may be repeatedly separated and re-secured.

Each pre-pack half 14, 16 has special internal formations. First, there is a series axially aligned egg cells having formations 18 spaced in line longitudinally and disposed centrally of the respective halves. Second, there are three transverse or circumferential formations 20 also spaced apart along the length of the respective halves. The formations in the two halves are complementary so as to define, when the halves are together, three egg-locating cavities. The oppositely disposed formations 18 of a cavity are contoured so as to contact an egg E therein at its pole regions and keep the adjacent pole regions of successive eggs apart, whilst being clear of the rest of the shell of the egg. The oppositely disposed transverse formations 20 are contoured to provide support for the egg at parts at least of its waist region only. The actual dimensions of the formations will be such as satisfactorily to accommodate a given range of egg sizes as will later be described in more detail.

Figure 7:
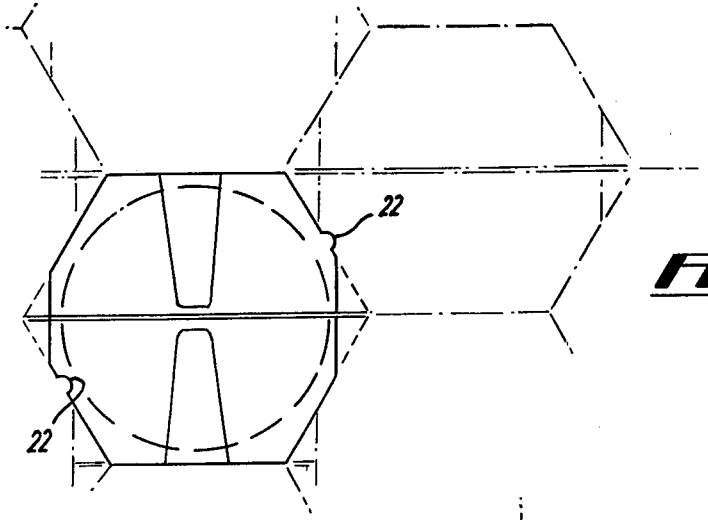
FIG. 7 is a diagrammatic end view, showing how the containers of FIGS 1–3 nest together on stacking.

The illustrated pre-pack has an external cross-sectional shape based on a regular hexagon and FIG. 7 shows how several pre-packs nest closely together when stacked. If desired, formations 22 may be provided on the sides of the pre-packs, which will interengage when the pre-packs are stacked and assist in securing the pre-packs in nested array.

In use the pre-packs just described have the advantageous features hereinbefore mentioned, namely:

(a) the manner of supporting the eggs leads to less damage to the eggs than in known pre-packs provided the range of sizes accommodated in a given pre-pack allows proper closure of the container on the one hand, and does not then allow excessive egg movement on the other hand;

(b) the shape is neat and allows of easy handling;

(c) numbers of pre-packs can be stacked in a manner which is economical of space and does not give rise to limited highly stressed areas of the pre-pack walls; and (d) the eggs in the pre-pack are visible for inspection without the need to open the pre-pack although the pre-pack may be repeatedly opened and closed for egg removal.

It is anticipated that production of pre-pack halves as part of a continuous egg-packing operation will not be difficult to arrange.

Figure 8:
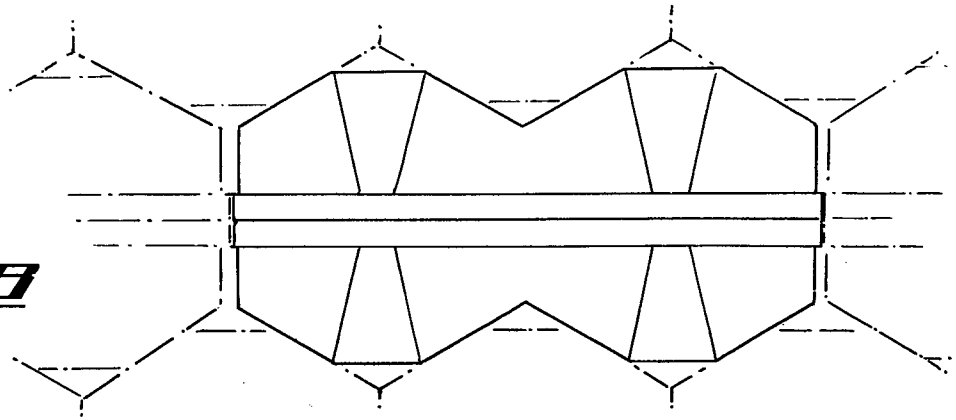
FIG. 8 is a diagrammatic end view, showing how the containers of FIGS. 4–6 nest together on stacking.
Figure 4:
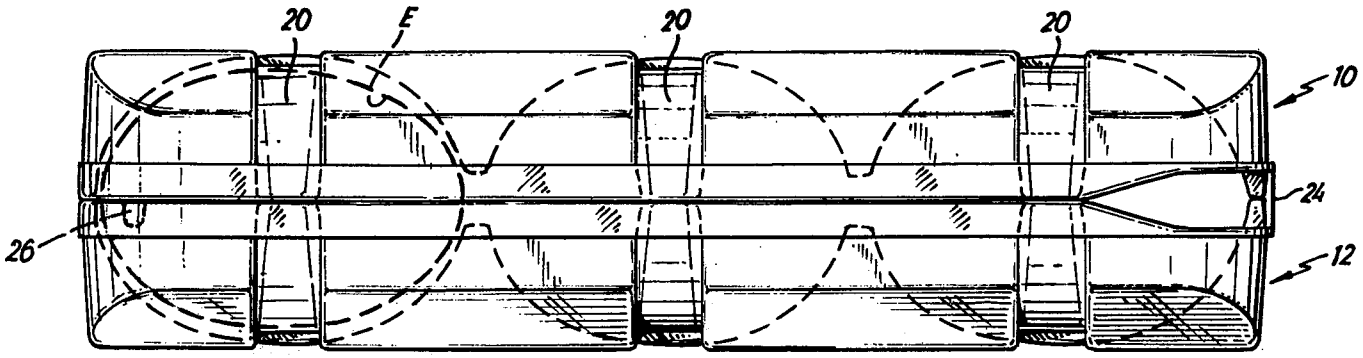
FIG. 4 is a front elevation of a container for six eggs, also in accordance with the invention.
Figure 5:
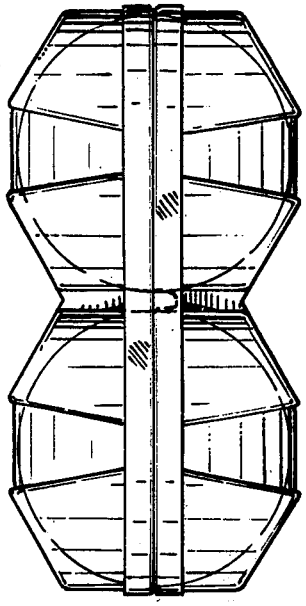
FIG. 5 is an end elevation corresponding to FIG. 4.
Figure 6:
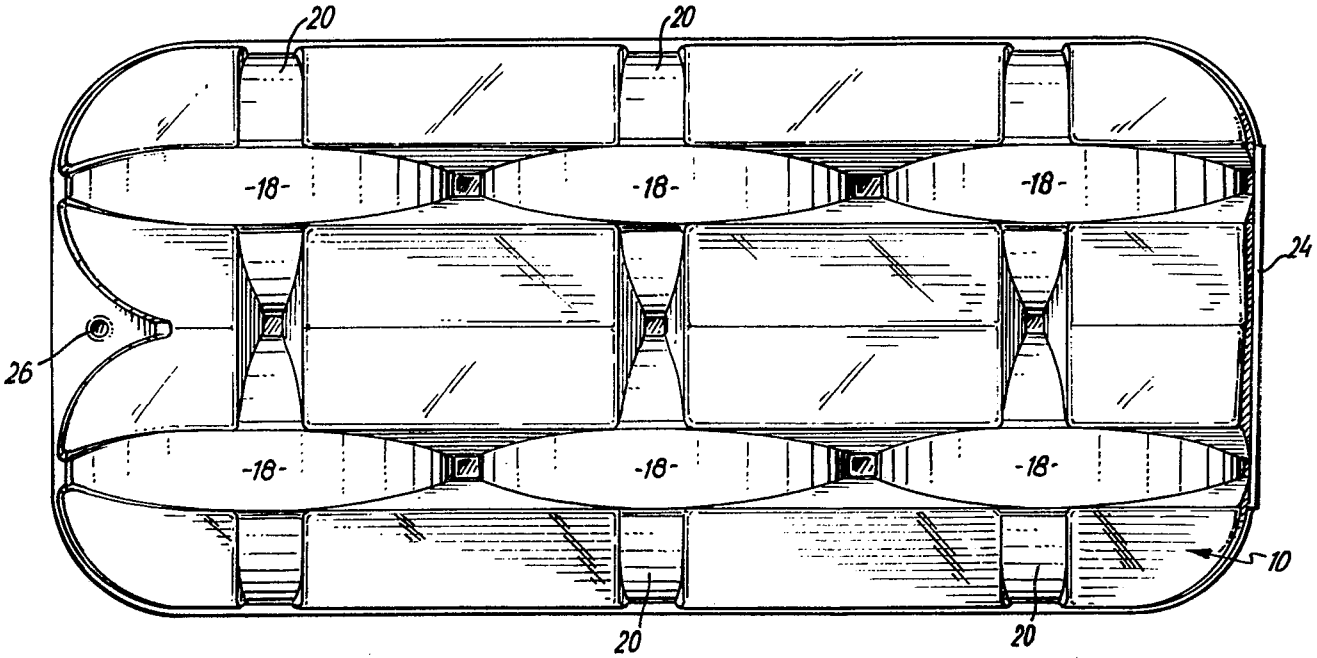
FIG. 6 is a plan view corresponding to FIG. 4.

Referring now to FIGS. 4 to 6 there is illustrated a pre-pack for six, rather than three eggs. Internally the pre-pack, is, in essence, the equivalent of a pre-pack for three eggs, as described above, side-by-side with a like three egg pre-pack and the same reference numerals are used for packs corresponding to parts illustrated in FIGS. 1–3. Externally the shape in end view (FIG. 5) is based on two hexagons, side-by-side, to allow nesting as shown in FIG. 8.

However, in this case a flexible hinge 24 is provided at one end of the pre-pack and a spigot closure 26 at the other end, so that the pre-pack may be readily and repeatably opened and closed.

The invention is not, of course, restricted to the detailed features of the embodiments just described by way of example. Thus, although we prefer to use a transparent plastics material for the packs, more traditional material such as wood pulp may be employed. In such event the pack would conveniently be made by a combination of vacuum forming and hot moulding techniques. Also, whilst a pre-pack for a single longitudinal row of eggs, or two such rows side-by-side, is preferred, other combinations of rows and eggs per row are not excluded. Again, the method of connecting the pre-pack halves may be varied. One alternative is to provide hinge means for the two halves together with a releasable detent. Another is to adopt spigot closures for the two halves.

Turning now to the specific shape and dimensions of the internal formations 18, 20, these will be governed by the following considerations. First, for commercial purposes eggs are commonly graded by weight. However, it is the egg size, rather than the egg weight, which is important so far as the present invention is concerned. We have found for example that almost all eggs in the weight grades commonly sold in pre-packs in the United Kingdom fall into two size ranges of reasonable extent. One includes eggs having a waist circumference of from 44 mm to 47 mm and a maximum length of 64 mm. The other includes eggs having a waist circumference of from 41 mm to 44 mm and a maximum length of 60 mm. Second, we regard the waist region as extending over a length of 10 mm and the region of a pole as extending from the end of the major axis of the egg up to the point where the egg has a radius of 10 mm at a section therethrough taken at right angles to said major axis. Accordingly, two differently dimensioned pre-packs could cope satisfactorily—that is, without allowing substantial movement of eggs within the pre-pack—with nearly all eggs. In the one pre-pack the egg-contacting ends of formations 18 would be 64 mm apart and the diameter of formations 20 would be 47 mm. In the other the corresponding dimensions would be 60 mm and 44 mm. Of course, only one size of pre-pack, or more than two sizes of pre-pack could be provided. In one particular form of pre-pack the internal formations 18, 20 consist of an annular circumferential formation 20 of from 44 mm to 47 mm entirely disposed between cuplike end formations 18 spaced apart by from 60 mm to 64 mm, said formations 18 having substantially complementary part-ellipsoid surfaces, the annular circumferential formation being 10 mm in width, and each cup-like end formation 18 having a maximum radius of 10 mm.

What is claimed is:

1. A pre-pack for a plurality of axially aligned egg cells, comprising two halves securable together in such manner that the halves are readily and repeatedly separable from each other, each half having external support surfaces and a plurality of internal egg contacting formations within each cell and spaced inwardly from the external surfaces, the formations on closure of the pre-pack defining a plurality of single-egg accommodating locations supporting eggs with their major axes in alignment and preventing eggs therein from coming into contact with each other, each said single-egg accommodating location being defined by a circumferentially extending formation shaped to contact the egg only at its waist region thereof which waist region comprises the circumference of the egg at its minor axis, and a longitudinally-extending formation intersecting said circumferentially extending formation and shaped to contact the egg only at the extremities of the egg at its major axis.

2. A pre-pack for a plurality of axially aligned egg cells comprising two halves securable together in such manner that the halves are readily and repeatably separable from each other, each half having external support surfaces and a plurality of internal egg contacting formations within each cell and spaced inwardly from the external surfaces, the formations on closure of the pre-pack defining a plurality of single-egg accommodating locations supporting eggs with their major axes in alignment and preventing eggs therein from coming into contact with each other, each said single-egg accommodating location being defined by a circumferentially extending formation shaped to contact the egg only at its waist region thereof which waist region comprises the circumference of the egg at its minor axis, and a longitudinally-extending formation intersecting said circumferentially extending formation and shaped to contact the egg only at the extremities of the egg at its major axis and at its waist region.

3. A pre-pack as set forth in claim 1 or 2 and which is elongate and has an external transverse cross-sectional shape based on a nesting geometrical figure whereby to facilitate nesting of a plurality of such pre-packs together.

4. A pre-pack as set forth in claim 2 in which the nesting geometrical figure is a regular hexagon.

5. A pre-pack as set forth in claim 2 having external formations adapted releasably to interlock with like formations on identical pre-packs when in stacked relationship therewith.

6. A pre-pack as set forth in claim 1 or 2 which accommodates at least two side-by-side series of a plurality of eggs in line.

7. A pre-pack as set forth in claim 1 or 2 in which said internal formations of each egg accommodating location consist of an annular circumferential formation of from 44 mm to 47 mm diameter centrally disposed between egg contacting end formations spaced apart by from 60 mm to 64 mm, said egg contacting formations having substantially complementary part-ellipsoidal surfaces, the annular circumferential formation being about 10 mm in width, and each egg contacting end formation extending from a point where it would contact the end of the major axis of an egg in said location up to where a section therethrough taken at right angles to said major axis has a maximum radius of 10 mm.

8. A pre-pack according to claim 1 or 2, wherein each half has a base with longitudinally-extending parallel edges and side walls connected to and extending outwardly from the edges of the base, the planes of the side walls being transverse to the plane of the base, the halves when assembled forming a nesting geometric figure such that the base and side walls of a lower half of a given pre-pack form support surfaces for contacting and supporting the given pre-pack on a plurality of nested lower pre-packs and such that the base and side walls of an upper half of the given pre-pack form support surfaces for contacting and supporting a plurality of pre-packs nested above the given pre-pack.

9. A pre-pack according to claim 8, wherein the circumferentially extending formation is spaced inwardly from the base and side walls and the longitudinally-extending formation is spaced inwardly from the base.

* * * * *